US006407620B1

(12) United States Patent
Hirayama

(10) Patent No.: US 6,407,620 B1
(45) Date of Patent: Jun. 18, 2002

(54) CURRENT MIRROR CIRCUIT WITH BASE CURRENT COMPENSATION

(75) Inventor: Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/234,302

(22) Filed: Jan. 21, 1999

(30) Foreign Application Priority Data

Jan. 23, 1998 (JP) ..... 10-011761

(51) Int. Cl.[7] ..... G05F 1/10
(52) U.S. Cl. ..... 327/538; 323/315
(58) Field of Search ..... 327/538, 539, 327/540, 541, 543; 323/312, 315

(56) References Cited

U.S. PATENT DOCUMENTS 4,855,618 A * 8/1989 Brokaw ..... 327/528
5,430,395 A * 7/1995 Ichimaru ..... 327/312
5,541,551 A * 7/1996 Brehner et al. ..... 327/539
5,568,045 A * 10/1996 Koazechi ..... 323/314
5,594,326 A * 1/1997 Gilbert ..... 323/313
5,936,392 A * 8/1999 Taylor ..... 323/315
5,982,201 A * 11/1999 Brokaw et al. ..... 327/53
6,002,243 A * 12/1999 Marshall ..... 323/313

FOREIGN PATENT DOCUMENTS

JP 5-37260 2/1993 ..... H03F/3/343

* cited by examiner

*Primary Examiner*—Terry D. Cunningham
(74) *Attorney, Agent, or Firm*—Fitzpatrick, Cella, Harper & Scinto

(57) ABSTRACT

In a current mirror circuit having different output ratios or outputting a plurality of output currents, the present invention provides a current mirror circuit which suppresses the influence of an early effect of a transistor serving as a reference and achieves an effect of base current compensation. In the current mirror circuit utilizing a common base transistor for an output stage, the base current of the common base transistor for the output stage is subtracted from the sum of the base current of a first transistor inputting a reference current and the base current of a second transistor where the base of the first transistor and the base of the second transistor are commonly connected. The resultant current is added to a current output terminal at the same current ratio as an input/output current ratio of the current mirror circuit and output.

3 Claims, 3 Drawing Sheets

CURRENT MIRROR CIRCUIT WITH BASE CURRENT COMPENSATION

BACKGROUND OF THE INVENTION

The present invention relates to a current mirror circuit used in a semiconductor integrated circuit.

As a conventional highly precise current mirror circuit, the Wilson-type current mirror circuit as shown in FIG. 4 or a circuit disclosed in Japanese Patent Application Laid-Open No. 5-37260 is available.

However, in these conventional current mirror circuits, a highly precise output current is obtained only when a current ratio between an input current and an output current is 1:1. In a case where an input current and an output current are different, or a current mirror circuit is designed to obtain a plurality of output currents from one reference current, the following problems arise.

FIG. 4 is a circuit diagram showing the Wilson-type current mirror circuit having a different current ratio between an input current and an output current. Referring to the circuit shown in FIG. 4, the emitter area ratio of transistors 2 and 3 serving as a reference is set to 1:N to attain a current ratio 1:N, and the emitter area ratio in transistors 4 and 5 is set to 1:N in correspondence with each current. Reference numeral 1 denotes a power supply line, and 12 denotes a reference current source. In the circuit shown in FIG. 4, a collector voltage of the transistors 2 and 3 serving as a reference is evenly controlled by the transistors 4 and 5. Therefore, current variation caused by early voltage of the transistors 2 and 3 can be suppressed. However, the advantage of Wilson-type current mirror circuit, that is, reduction of errors in the base current of each transistor, cannot be attained.

Herein, assume that the base current of the transistors 2 and 4 is $I_b$ and the base current of the transistors 3 and 5 is $N \times I_b$, the relation of an input current and an output current is expressed by the following equation (1).

$$I_{OUT}=N \cdot I_{IN}-(N^2-1)I_b \quad (1)$$

As can be seen from equation (1), $(N^2-1)$ times $I_b$ which is a base current ($I_b$) of a transistor on the side of the reference current source, as expressed as the second term of the right side of the equation, acts as an error against a desired output current ($NI_{IN}$). Herein, assuming that a collector current of the transistor 2 is $I_c$, and a current amplification factor is β, equation (1) is expressed by the following equation (2).

$$I_{out}=N \cdot I_{IN}-(N^2-1)I_c/\beta \quad (2)$$

As can be seen from equation (2), the current amplification factor (β) of the transistor, which appears in the second term of the right side of the equation is a variation factor in the manufacturing process. Therefore, the current amplification factor varies if the quality of transistors varies, and as a result, the output current is largely influenced. Because of this, the conventional Wilson-type current mirror circuit is unable to structure a highly precise current mirror circuit.

Furthermore, FIG. 5 is an example of a current mirror circuit structured such that a plurality of output currents are obtained. In FIG. 5, reference numerals 15 and 16 denote transistors. In this case also, an effect of base current compensation cannot be achieved, similar to the circuit shown in FIG. 4 as an example.

SUMMARY OF THE INVENTION

The present invention is made in consideration of the above situation, and has as its object to provide a current mirror circuit which suppresses the influence of early effect of a transistor serving as a reference and which has an effect of base current compensation in a current mirror circuit having a different current ratio between input current and output current or in a current mirror circuit which obtains a plurality of output currents, and an inkjet printing apparatus using the current mirror circuit.

According to one aspect of the present invention, the foregoing object is attained by providing a current mirror circuit utilizing a common base transistor for an output stage, wherein a current obtained by subtracting a base current of the common base transistor of the output stage from a sum of a base current of a first transistor inputting a reference current and a base current of a second transistor where the base of the first transistor and the base of the second transistor are commonly connected, is added to a current output terminal at the same current ratio as an input/output current ratio of the current mirror circuit.

According to another aspect of the present invention, the foregoing object is attained by providing a current mirror circuit comprising a first transistor of a first conductive type where a collector is connected to a reference current source and a base is commonly connected, wherein an emitter and a base of a second transistor of the first conductive type are respectively connected to between the base and the collector of the first transistor, a terminal on the reference current side of the first current mirror circuit is connected to a collector of the second transistor, a collector of a third transistor of the first conductive type, which is commonly connected to the base of the first transistor, is connected to an emitter of a fourth transistor of the first conductive type, a base of a fifth transistor of a second conductive type is connected to the collector of the first transistor, an emitter of the fifth transistor is connected to a base of the fourth transistor and a terminal on an output side of the first current mirror circuit, a collector of the fifth transistor is connected to a terminal of a reference current side of a second current mirror circuit, a terminal on an output side of the second current mirror circuit is connected to a collector of the fourth transistor, and an output current is obtained from the connection point.

According to still another aspect of the present invention, the foregoing object is attained by providing an inkjet printing apparatus comprising a current supply circuit which includes a current mirror circuit having the above-mentioned construction.

In a case where the inkjet printing apparatus have a printhead integrating a rank resister for detecting a resistance indicating a characteristic of the printhead, the current supply circuit preferably supplies an electric current into the rank resistor.

Also, in a case where the inkjet printing apparatus have a printhead integrating a temperature sensor for sensing a temperature of the printhead, the current supply circuit preferably supplies an electric current into the temperature sensor.

The invention is particularly advantageous since an error caused by the early effect and an error in a base current are reduced and a highly precise current mirror output is obtained in a current mirror circuit having a different mirror ratio or in a current mirror circuit having a plurality of output currents.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention, and together with the description, serve to explain the principles of the invention.

DETAILED DESCRIPTION OF THE PREFERRED EMBODIMENT

Preferred embodiment of the present invention will be described in detail in accordance with the accompanying drawings.

Figure 1:
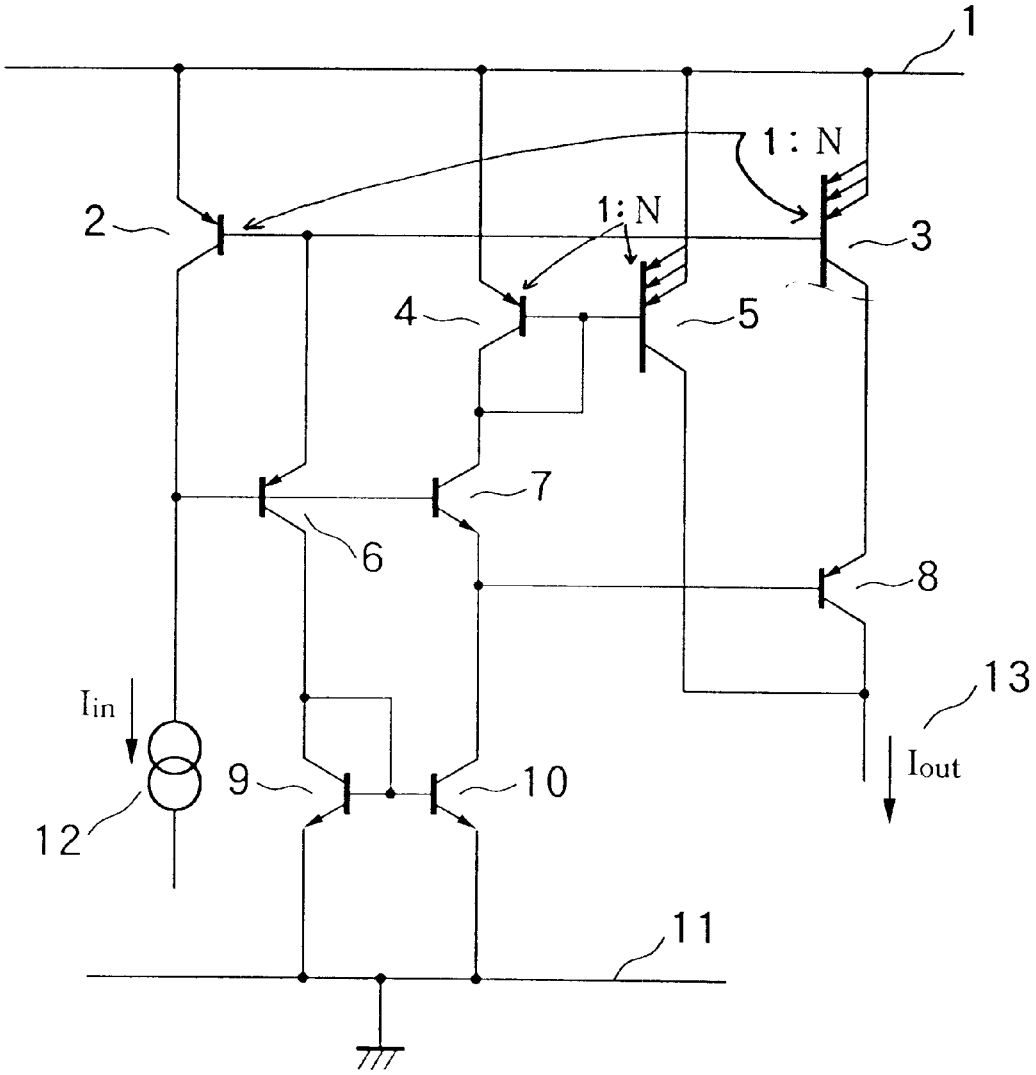
FIG. 1 is a circuit diagram showing a current mirror circuit structure according to a typical embodiment of the present invention.

FIG. 1 is a circuit diagram showing a current mirror circuit structure according to a typical embodiment of the present invention.

The circuit shown as an example in FIG. 1 is a circuit where a current ratio between an input current ($I_{in}$) and an output current ($I_{out}$) is multiplied by N. The current mirror is constructed by conductive-type (in the present embodiment, PNP) first transistors 2 and 3 whose bases are commonly connected. The emitter area ratio is set to N to attain a desired ratio or the output current to refer current.

Emitters of the transistors 2 and 3 are connected to a power supply line 1, and the collector of the transistor 2 is connected to a reference current source 12. The emitter of a PNP transistor 6 which performs base current compensation is connected to the base of the transistors 2 and 3 while the base of the PNP transistor 6 is connected to the collector of the transistor 2. The collector of the transistor 6 is connected to the collector of a second conductive-type (NPN) transistor 9. As a reference current of the current mirror constructed by transistors 9 and 10, the collector current of the transistor 6 is used. The emitter of a PNP transistor 8, which is used to reduce an early effect of the transistor 3, is connected to the collector of the transistor 3, and the collector of the transistor 8 serves as the current output terminal 13.

The base of an NPN transistor 7 is commonly connected to the base of the transistor 6, and the emitter of the NPN transistor 7 is connected to the base of the transistor 8. Furthermore, the emitter of the transistor 7 and the base of the transistor 8 are connected to the collector of the transistor 10.

A current mirror circuit constructed by PNP transistors 4 and 5 has an emitter size ratio of 1:N so as to achieve the same mirror ratio as that of the transistors 2 and 3. In the current mirror circuit constructed by the transistors 4 and 5, which employs the collector current of the transistor 7 as a reference, the collector of the transistor 4 is connected to the collector of the transistor 7, and the collector of the transistor 5 on the output side of the current mirror circuit is connected to the collector of the transistor 8.

The transistor 8 is a common base-grounded transistor for suppressing variation of output currents caused by changes in an output potential due to an early effect of the transistor 3. The collector potential of the transistor 3 is approximately the same potential as the collector potential of the transistor 2 because of a potential ($V_{BE}$) between the base and the emitter of the transistor 8, and a potential ($V_{BE}$) between the base and the emitter of the transistor 7. The collector potential of the transistor 2 is fixed to a potential lower than the base potential of the transistors 2 and 3 by the amount of a potential ($V_{BE}$) between the base and the emitter of the transistor 6. The collector potential of the transistors 2 and 3 is equipotentially fixed to a potential lower than the base potential by the amount of the potential ($V_{BE}$) between the base and the emitter. Accordingly, an error in an output current caused by an early voltage effect of the transistors 2 and 3 can be reduced.

An error of the base current in the common base, rounded transistor 8 is compensated by a current loop formed by the transistors 4, 5, 6, 7, 9 and 10.

Hereinafter, operation of the current loop is described. Note that herein, the base currents of the transistors in the loop are ignored.

The transistor 6 serves to fix the collector potential of the transistor 2, and supplies a base current of the transistors 2 and 3, thereby reducing the influence of the reference current to $1/(1+\beta)$ of the base current of the transistors 2 and 3. Herein, $\beta$ is a current amplification factor of the transistor 6. Since the size ratio between the transistors 2 and 3 is set to 1:N, the relationship between the base current ($I_2$) of the transistor 2 and the base current ($I_{B3}$) of the transistor 3 is expressed by the following equation (3).

$$I_{B3}=N\times I_{B2} \tag{3}$$

Assume that the base current of the transistor n (n is a positive integer) is $I_{Bn}$, collector current is $_{Icn}$, and emitter current is $_{Ien}$. In general, $I_{C6}$ is mirrored by the transistors 9 and 10 and $I_{C10}$ is output, and the collector current ($I_{C6}$) of the transistor 6 is approximated as $I_{C6}\approx I_{B3}+I_{B2}$. Herein, considering equation (3), the collector current ($I_{C6}$) of the transistor 6 is expressed by the following equation (4).

$$I_{C6}\approx(1+N)I_{B2}\approx I_{C10} \tag{4}$$

Meanwhile, as mentioned above, the transistor 7 serves to fix the base potential of the output common-grounded base transistor 8, and supplies the reference current source 12 with a current $I_{B7}$ flows opposite to the base current of the transistor 6 so as to further reduce the amount of current which causes an error of the reference current source 12 and $I_{C2}$. Furthermore, the transistor 7 supplies the current mirror, constructed by the transistors 4 and 5, with a current obtained by subtracting $I_{B8}$ from $I_{C10}$. Since the mirror ratio of the transistors 4 and 5 is N, the collector current ($I_{C7}$) of the transistor 7 is approximated as $I_{C7}\approx I_{C10}-I_{B8}$, and the collector current ($I_{C5}$) of the transistor 5 is expressed by the following equation (5).

$$I_{C5}\approx N\times I_{C7}=N\times(I_{C10}-I_{B8}) \tag{5}$$

Therefore, the collector current ($I_C$) of the transistor 5 is expressed by equation (6) based on equations (4) and (5).

$$I_{C5}\approx N\times\{(1+N)I_{B2}-I_{B8}) \tag{6}$$

Herein, the collector current ($I_{B8}$) of the transistor 8 is expressed by the following equation (7).

$$I_{B8}=I_{E8}/(1+\beta)=I_{C3}/(1+\beta)=N\times I_{C2}/(1+\beta) \tag{7}$$

The collector current ($I_{B8}$) of the transistor 8 is expressed by the following equation (8) based on equations (3) and (7).

$$I_{B8}=N\cdot(\beta/(1+\beta))\cdot I_{B2} \text{ or } I_{B2}=(1+1/\beta)\cdot I_{B8}/N \quad (8)$$

As can be seen from FIG. 1, an ultimately obtained output current ($I_{out}$) is the sum ($I_{out}=I_{C8}+I_{C5}$) of the collector current of the transistor 8 and the collector current of the transistor 5. Therefore, considering equation (6), the output current is expressed by the following equation:

$$I_{out}=N\times I_{in}-I_{B8}+N\cdot\{(1+N)\cdot I_{B2}-I_{B8}\}=N\times I_{in}-(1+N)\cdot I_{B8}+N\cdot(1+N)\cdot I_{B2}$$

Furthermore, considering equation (8) in addition to the above equation, the output current ($I_{out}$) is finally expressed by equation (9).

$$I_{out}=N\times I_{in}+\{N\cdot(1+N)/(1+\beta)\}\cdot I_{B2}=N\times I_{in}+[N\cdot(1+N)/\{(1+\beta)\beta\}]\cdot I_{C2} \quad (9)$$

Thus according to the present embodiment, as apparent from comparison between equation (9) and equation (2) which expresses the output current of the Wilson-type current mirror circuit described as the conventional example, the second term in the right side of the equation, which is an error factor, is multiplied by a coefficient $1/(1+\beta)$. By this, the effect of base current compensation is enhanced, and a stabilized, highly precise current mirror circuit can be provided despite the amplification factor ($\beta$) of the transistor, which is a variation factor in the manufacturing process.

Figure 2:
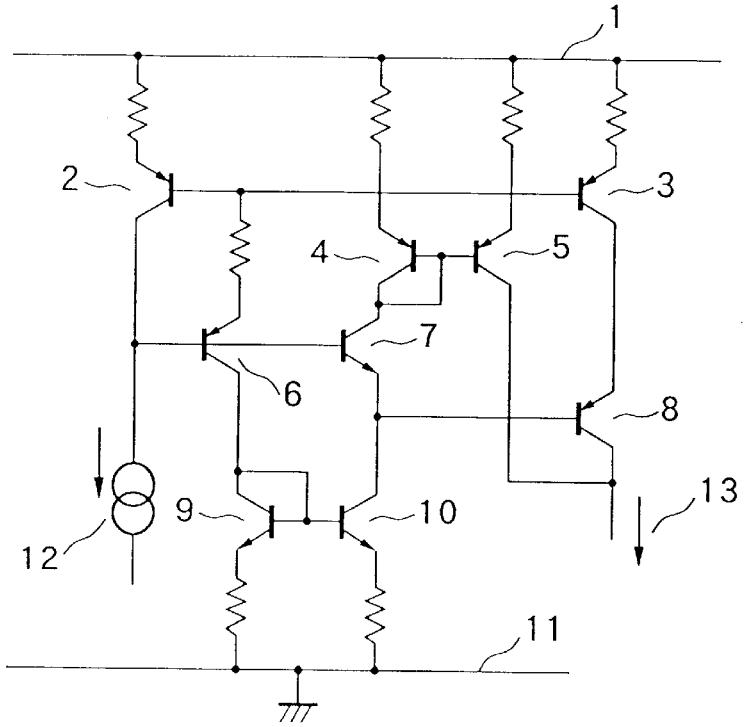
FIG. 2 is a circuit diagram of a current mirror circuit where an emitter resistance is inserted in the circuit shown in FIG. 1.

Note that by adding an emitter resistance as shown in FIG. 2 to the circuit structure shown in FIG. 1, relative precision errors of the transistor can be compensated, and the foregoing effect of the present invention can be enhanced further.

Figure 3:
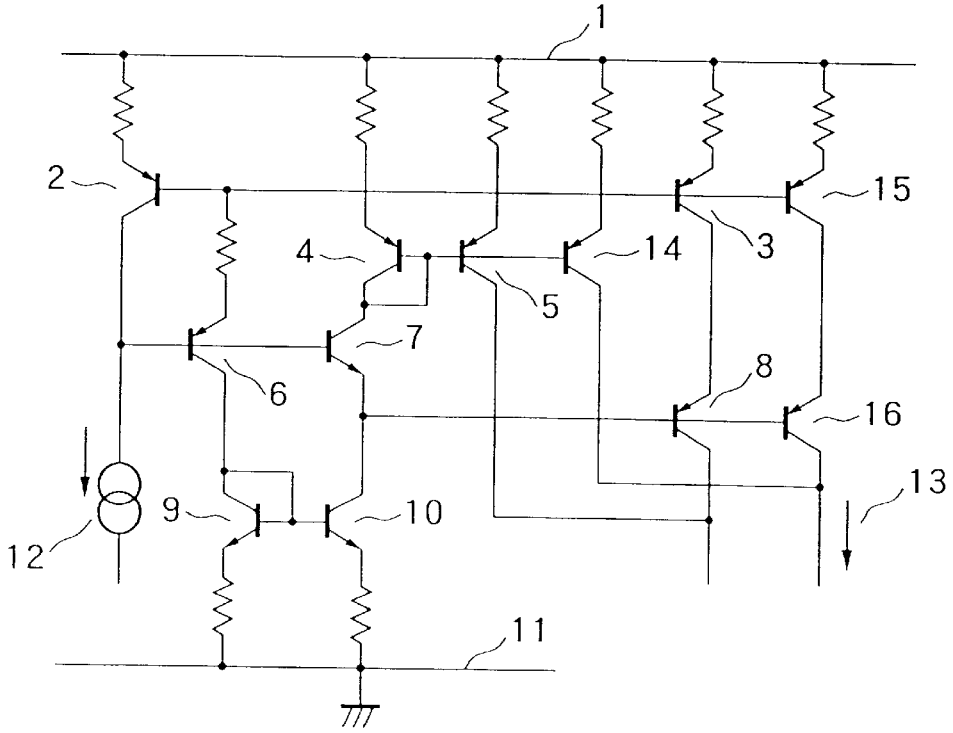
FIG. 3 is a circuit diagram of a current mirror circuit having a plurality of output currents.
Figure 4:
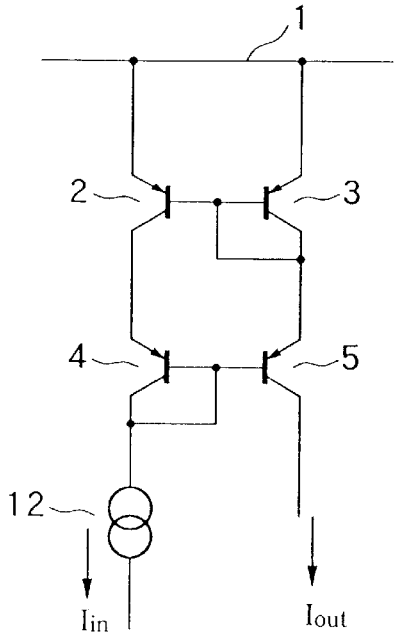
FIG. 4 is a circuit diagram of an example of a conventional current mirror circuit.
Figure 5:
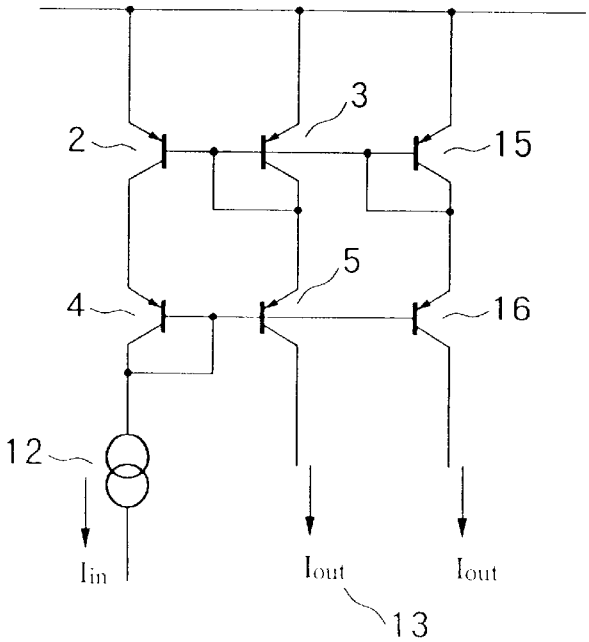
FIG. 5 is a circuit diagram of a current mirror circuit having a plurality of output currents.

Although the above embodiment has described a circuit structure which obtains a single output current, the present invention is not limited to this. By having a circuit structure shown in FIG. 3, a plurality of output currents may be obtained. Even in such structure, similar to the above-described embodiment, the early effect of each transistor is reduced, and base current is compensated.

The present invention can be applied to a system constituted by a plurality of devices (e.g., host computer, interface, reader, printer) or to an apparatus comprising a single device (e.g., copying machine, facsimile machine).

Particularly, the current mirror circuit according to the present invention is applied to a circuit supplying a constant current for detecting a value of a rank resistance indicating a characteristic of a printhead of an ink-jet printing apparatus, and/or to a circuit supplying a constant current to a diode of a temperature sensor, for sensing a temperature of the printhead, provided in the printhead. These circuits are incorporated in a printing apparatus as a part of a control circuit of the printing apparatus.

The present invention is not limited to the above embodiments and various changes and modifications can be made within the spirit and scope of the present invention. Therefore, to appraise the public of the scope of the present invention, the following claims are made.

What is claimed is:

1. A current mirror circuit comprising:

a first current mirror circuit and a second current mirror circuit, and further comprising;

a first transistor of a first conductive type, wherein a collector is connected to a reference current source and a base is commonly connected;

a second transistor of the first type, wherein an emitter and a base of the second transistor of the first conductive type are respectively connected between the base and the collector of said first transistor, and a terminal on said first reference current side of the current mirror circuit is connected to a collector of said second transistor;

third and fourth transistors of the first conductive type, wherein a collector of said third transistor of the first conductive type, which has a base commonly connected to the base of said first transistor, is connected to an emitter of said fourth transistor of the first conductive type, and an emitter of said first transistor is connected to an emitter of said third transistor;

a fifth transistor, said fifth transistor of a second type, wherein a base of said fifth transistor of a second conductive type is connected to the collector of said first transistor, an emitter of said fifth transistor is connected to a base of said fourth transistor and a terminal on an output side of said first current mirror circuit, wherein a collector of said fifth transistor is connected to a terminal of a reference current side of said second current mirror circuit, and a terminal on an output side of said second current mirror circuit is connected to a collector of said fourth transistor, whereby an output current is obtained from the connection point.

2. The current mirror circuit according to claim 1, further comprising sixth and seventh transistors of the first conductive type connected respectively to said third transistor and to said fourth transistor with a common base;

an eighth transistor of the first conductive type, said eighth transistor of the first conductive type connected to the output side of said second current mirror circuit with a common base, wherein a collector of the sixth transistor is connected to an emitter of the seventh transistor, and an emitter of the sixth transistor is connected to the emitter of the first transistor, wherein a collector of said seventh transistor is connected to an output from a collector of said eighth transistor, and wherein another output current of said second current mirror circuit obtained from the connection point of the collectors of said seventh and eighth transistors.

3. The current mirror according to claim 1, wherein the first conductivity type is PNP.

* * * * *

UNITED STATES PATENT AND TRADEMARK OFFICE

CERTIFICATE OF CORRECTION

PATENT NO. : 6,407,620 B1
DATED : June 18, 2002
INVENTOR(S) : Hirayama

It is certified that error appears in the above-identified patent and that said Letters Patent is hereby corrected as shown below:

Column 2,
Lines 46 and 51, “have” should read -- has --.

Column 4,
Line 28, “($I_2$)” should read -- ($I_{B2}$) --; and
Line 60, “($I_C$)” should read -- ($I_{C5}$) --.

Column 6,
Line 4, “comprising;” should read -- comprising: --.

Signed and Sealed this

Eleventh Day of February, 2003

JAMES E. ROGAN
*Director of the United States Patent and Trademark Office*